United States Patent [19]

Matsuo et al.

[11] Patent Number: 4,857,875

[45] Date of Patent: Aug. 15, 1989

[54] YOKE

[75] Inventors: Kenichi Matsuo; Muneo Nakata; Toru Ohara, all of Iida, Japan

[73] Assignee: Omron Tateisi Electronics Co., Kyoto, Japan

[21] Appl. No.: 13,570

[22] Filed: Feb. 11, 1987

[30] Foreign Application Priority Data

Feb. 13, 1986 [JP] Japan ..... 61-30497

[51] Int. Cl.[4] ..... H01F 3/00

[52] U.S. Cl. ..... 335/297; 335/281

[58] Field of Search ..... 335/281, 297, 796, 276; 336/211, 212, 213, 214, 215

[56] References Cited

U.S. PATENT DOCUMENTS 3,158,712 11/1964 DeFligue ..... 335/276 X 3,188,532 6/1965 Auer ..... 335/276 X

FOREIGN PATENT DOCUMENTS 3415761 10/1985 Fed. Rep. of Germany ..... 335/281

347910 5/1931 United Kingdom ..... 335/276

355667 8/1931 United Kingdom ..... 335/276

723784 2/1955 United Kingdom ..... 335/281

2149975 6/1985 United Kingdom ..... 335/281

*Primary Examiner*—George Harris

[57] ABSTRACT

As thin type yoke having excellent magnetic characteristic to including a pair of yoke segments having a wide iron segment attracting part which is extended and bent at the one end of a coil winding part, wherein said coil winding part is offset in the lateral direction and the end part thereof is mutually and placed in contact with the wide iron segment attracting part of the other yoke segment.

9 Claims, 2 Drawing Sheets

FIG. 1
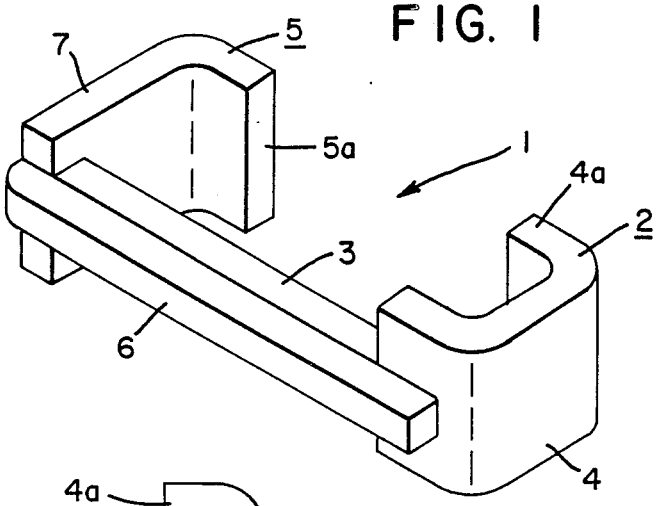
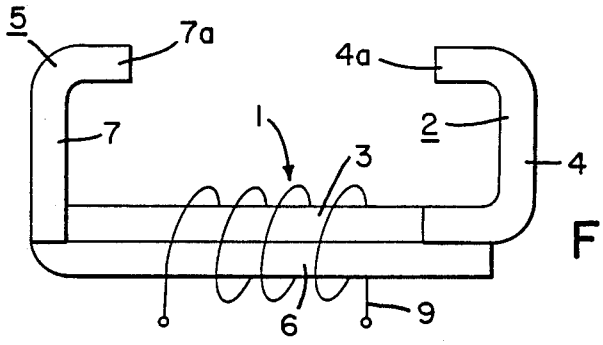
FIG. 2
FIG. 3
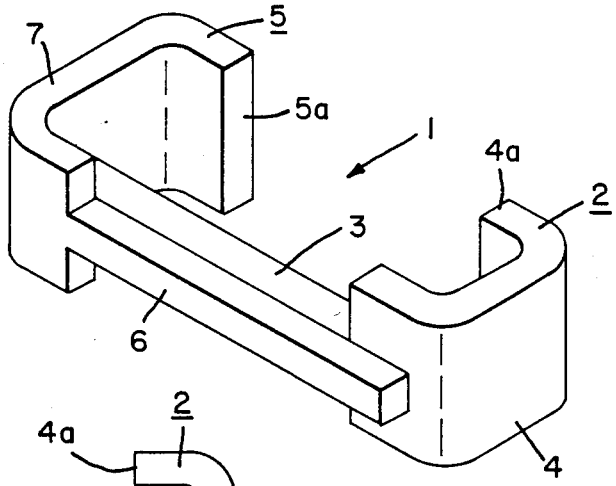
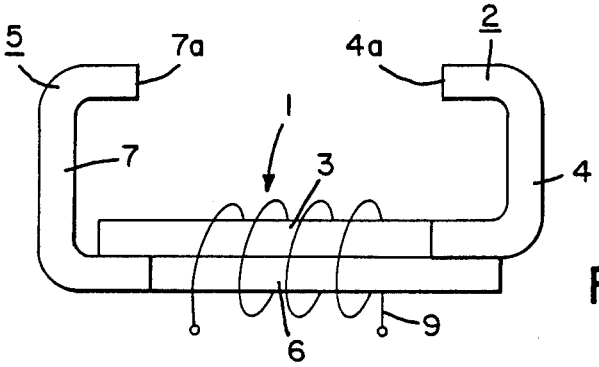
FIG. 4

YOKE

FIELD OF THE INVENTION

The present invention relates to a yoke for use as an electromagnetic apparatus.

BACKGROUND OF THE INVENTION

Typically a yoke forming an electromagnetic apparatus, the upper and lower edges located at the coil winding part of yoke are cut out and a coil is wound around this coil winding part in order to form a thin electromagnetic apparatus. However, there is a disadvantage to such a yoke of the prior art, in that reduction of sectional area generated by cutting out part of the coil winding part increases magnetic resistance and thereby lowers the attractive force and sensitivity of the electromagnetic apparatus.

To overcome these, as illustrated in FIG. 5 and FIG. 6, has been used wherein pair of yoke segment 2, 5 are formed by extending the almost L-shaped wide iron segment attracting portions 4, 7 from the one end of the coil winding parts 3, 6 and bending such iron segment attracting portions 4, 7 in almost right angles from the boundaries 3*a*, 6*a*. The coil winding portion 3 of yoke segment 2 is longitudinally disposed on coil winding part 6 of the other yoke segment 5 and simultaneously the end surface of coil winding part 3 is placed in contact with the internal side of the wide iron segment attracting portion 7.

However, such a yoke provides a problem in that; since the end part of coil winding part 6 is not in contact with the iron segment attracting part 4 of the other yoke segment 2, the sectional area of boundary 3*a* of yoke segment 2 is locally reduced and the attractive force and sensitivity are lowered because of the increase of magnetic resistance.

SUMMARY OF THE INVENTION

A yoke in accordance with the present invention overcomes the problems described above in that the coil winding portions of a pair of yoke segments having the wide iron segment attracting portions, which is extended and bent at one end of the coil winding portion, are provided mutually along the longitudinal direction and the end portions thereof are mutually and placed in contact with the wide iron segment attracting portions of the other yoke segment.

Therefore, according to the present invention, since the coil winding portions of each yoke segment are mutually in contact with the wide iron segment attracting portion of the other yoke segment, the open cross sectional areas of yoke are almost equal.

Accordingly, an electromagnetic apparatus is provided which does not allow any increase in magnetic resistance and assures less reduction of attractive force and sensitivity due to the local reduction of sectional areas.

Moreover, since the coil winding portion is provided along the plate in a longitudinal direction, when a coil is wound to the coil winding portion, the coil is wound flat, resulting in the effect of achieving a thin electromagnetic apparatus.

BRIEF DESCRIPTION OF THE DRAWINGS

FIG. 1 and FIG. 2 illustrates the perspective view and plan view of the first embodiment of the present invention.

FIG. 3 and FIG. 4 illustrate the perspective view and plan view of the second embodiment of the present invention.

DETAILED DESCRIPTION OF THE INVENTION

Figure 5:
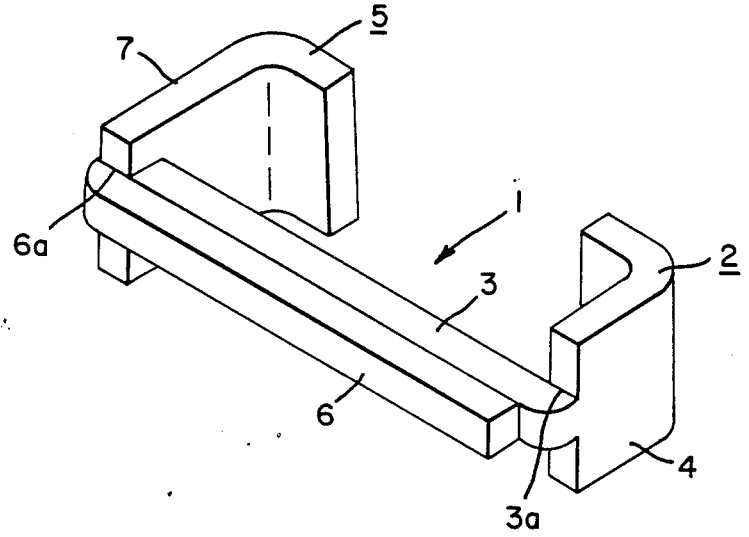
FIG. 5 PRIOR ART
FIG. 5 and FIG. 6 illustrate the perspective view and plan view of an embodiment of the prior art.
Figure 6:
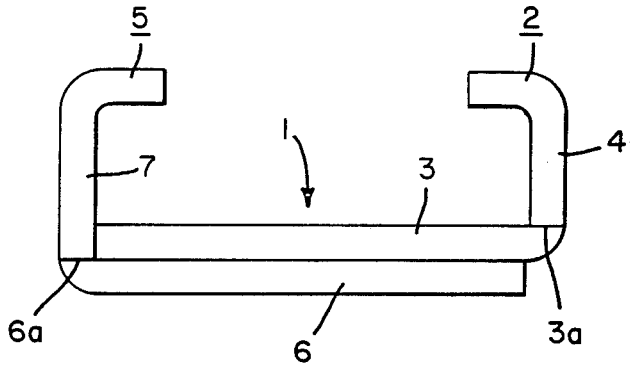
FIG. 6 PRIOR ART

An embodiment of the present invention will be explained with reference to the attached drawings of FIG. 1 to FIG. 4.

The yoke 1 of the first embodiment is combined with the yoke segment 2 and the yoke segment 5 as illustrated in FIG. 1 and FIG. 2.

Namely, the yoke segment 2 is formed by extending the wide iron segment attracting part 4 from the one and of the coil winding part 3 and bending such iron segment attracting part 4 in a substantially C-shape.

On the other hand, the yoke segment 5 is formed by extending almost the L-shaped wide iron segment attracting part 7 from the one end of the coiling winding part 6 and bending such iron segment attracting part 7 in almost a right angle.

The yoke 1 is then formed by attaching the coil winding part 3 of the yoke segment 2 to the coil winding part 6 of the yoke 5 in the longitudinal direction while coupling the end surface of said coil winding part 3 with the internal surface of the iron segment attracting part 7 and coupling the internal surface at the end part of coil winding part 6 with the external surface of the iron segment attracting part 4. Coil 9 is wound about coil winding portions 3, 6 which form the yoke 1. 4*a*, 7*a* are bending portions which become the magnetic pole surfaces.

Therefore, according to the present invention, the end part of coil winding part is cross sectional non contact areas in contact with the wide iron segment attracting part, and the cross-sectional non-contact areas of yoke 1 are almost equal. Therefore, leakage of magnetic flux is reduced and any increase of magnetic resistance due to local reduction of sectional areas can be eliminated and an electromagnet apparatus having excellent attracting force and sensitivity can be achieved.

Moreover, the present invention provides the following advantage that since said coil winding portions 3, 6 are provided along the longitudinal direction, when a coil is wound to the coil winding portions 3, 6 the coil can be wound relatively flat and thereby a thin electromagnetic apparatus can be attained.

In the first embodiment, the iron segment attracting part 4 of the one yoke segment 2 is bent in almost a C-shape and the almost L-shaped iron segment attracting part 7 provided to the other yoke segment 6 is bent almost at the right angle. Meanwhile, in the second embodiment, the iron segment attracting portions 4, 7 of yoke segments 2, 5 are almost in the C-shape. (FIG. 3, FIG. 4)

The yoke 1 of this second embodiment is formed by attaching the coil winding part 3 of the yoke segment 2 to the coil winding part 6 of the other yoke segment 5 in the longitudinal direction while the external side surface of the end part of coil winding part 3 is coupled with the internal surface of the iron segment attracting part 7 of the yoke segment 6, and the internal surface of end part of the coil winding part 6 is coupled with the external side surface of the iron segment attracting part 4 of the yoke segment 2.

Other structure is the same as the previous embodiment and is not explained repeatedly.

According to this embodiment, there arises an advantage that since the open cross sectional areas are not reduced even when the coil winding portions 3, 6 of the yoke segments 2, 5 are slid a little in the longitudinal direction, size adjustment becomes easy, thus providing a degree of freedom in arrangement of the electromagnet apparatus itself.

The bending portions 4*a*, 7*a* located at the end portions of the iron segment attracting portions 4, 7 are not always required and these may be used as needed.

What is claimed is:

1. An electromagnetic yoke device, comprising:

a first yoke segment having a transverse width;

a second yoke segment having a transverse width, wherein the first and second yoke segments extend in substantially the same direction;

a first coil winding part extending longitudinally between the first yoke segment and the second yoke segment, thereby contacting with the first and second yoke segments and having a transverse width across the portion contacting with the second yoke segment less than the transverse width of the second yoke segment; and a second coil winding part contiguous with at least a portion of the first coil winding part, contacting the first and second yoke segments and having a transverse width across the portion contacting with the first yoke segment less than the transverse width of the first yoke segment, wherein the first yoke segment and the second yoke segment are shaped so that equal contact is obtained with the first and second coil winding parts.

2. An electromagnetic yoke device as in claim 1 wherein a coil is wound about the first and second coil winding parts.

3. An electromagnetic yoke device as in claim 1 wherein the first yoke segment is substantially C-shaped.

4. An electromagnetic yoke device as in claim 1 wherein the second yoke is substantially L-shaped.

5. An electromagnetic yoke device as in claim 3 wherein the second yoke segment as substantially C-shaped.

6. An electromagnetic yoke device, comprising:

a first yoke segment having a transverse width;

a second yoke segment having a transverse width, wherein the first and second yoke segments extend in substantially the same direction;

a first coil winding part having internal and external sides extending longitudinally between the first yoke segment and the second yoke segment, thereby contacting with the first and second yoke segments and having a transverse width across the portion contacting with the second yoke segment less than the transverse width of the second yoke segment; and a second coil winding part having internal and external surfaces, at least one of which is contiguous with at least a portion of the first coil winding part, thereby contacting with the first and second yoke segments and having a transverse width across the portion thereof contacting with the first yoke segment less than the transverse width of the first yoke segment, wherein the first yoke segment and the second yoke segment are shaped so that equal contact is obtained with the first and second coil winding parts, and wherein the external side of the first coil winding part is in contact with the internal side of the second coil winding part.

7. An electromagnetic yoke device as in claim 2, wherein the first and second yoke segments form an opening therebetween which is wider than the portion of the first and second winding parts about which the coil is wound.

8. An electromagnetic yoke device as in claim 6, wherein a coil is wound about the first and second coil winding parts.

9. An electromagnetic yoke device as in claim 8, wherein the first and second yoke segments form an opening therebetween which is wider than the portion of the first and second winding parts about which the coil is wound.

* * * * *